United States Patent [19]

Durket

[11] 4,109,889

[45] Aug. 29, 1978

[54] BOOK HOLDER FOR STUDENT'S DESK

[76] Inventor: Michael P. Durket, 20701 Leonard Rd., Saratoga, Calif. 95070

[21] Appl. No.: 791,311

[22] Filed: Apr. 27, 1977

[51] Int. Cl.[2] ..... A47B 97/04

[52] U.S. Cl. ..... 248/447; 248/441 B; 108/32

[58] Field of Search ..... 108/27, 32; 297/160, 297/161, 162, 194; 248/117.1, 117.2, 117.3, 117.4, 117.5, 117.6, 117.7, 289 R, 441 A, 441 B, 441 C, 447

[56] References Cited

U.S. PATENT DOCUMENTS

| | | | |
|---|---|---|---|
| 573,089 | 12/1896 | Haynes | 108/32 |
| 1,446,936 | 2/1923 | Sellman et al. | 248/293 |
| 1,561,391 | 11/1925 | Wright | 248/293 |
| 1,737,081 | 11/1929 | Foucher | 248/117.4 |
| 2,193,414 | 3/1940 | Berkman | 248/117.1 X |
| 2,781,992 | 2/1957 | Cunningham | 248/293 X |
| 2,826,668 | 3/1958 | Haynes et al. | 248/117.1 X |
| 2,904,296 | 9/1959 | Graham | 248/117.7 |

*Primary Examiner*—William H. Schultz
*Attorney, Agent, or Firm*—Leslie M. Hansen

[57] ABSTRACT

A book holder for a student type desk for occupying a limited area adjacent the back edge thereof and adapted for permanent mounting thereon for storage on the underside of the desk top by a unique pivotal mount between the base portion and book supporting portion of such holder.

4 Claims, 6 Drawing Figures

FIG. 1
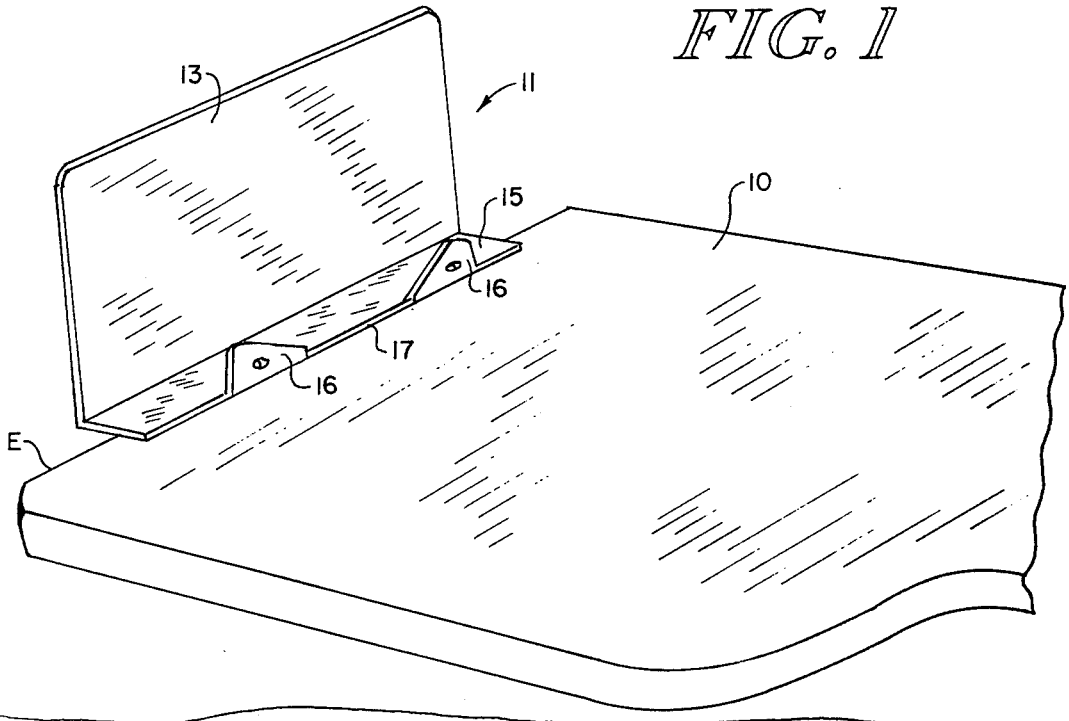
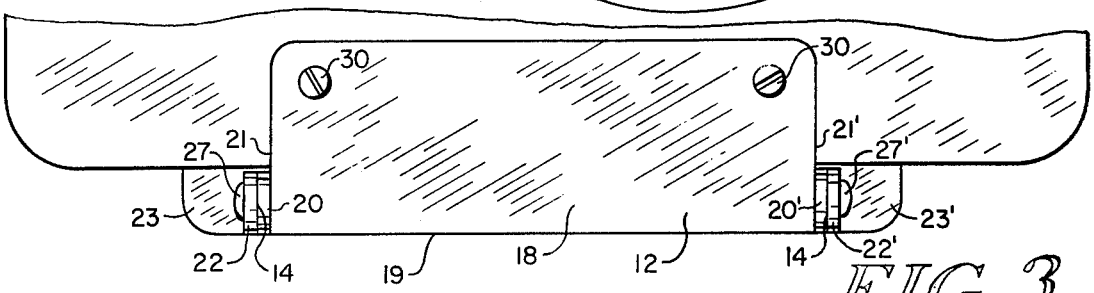
FIG. 3
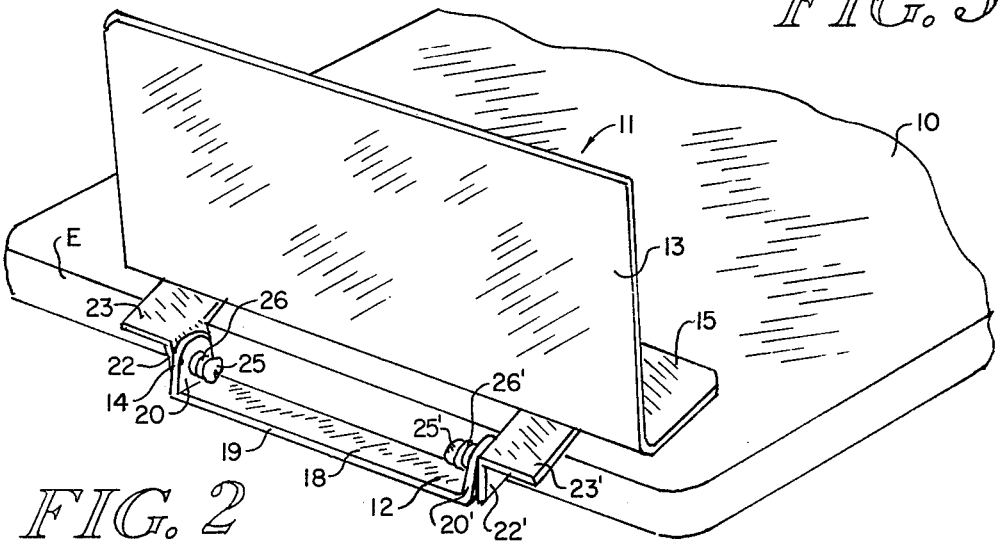
FIG. 2

BOOK HOLDER FOR STUDENT'S DESK

BACKGROUND

This invention relates to book holders and more particularly to a book holder for a student type desk.

Many types and kinds of book holders have been developed for use on table tops and the like for supporting an open book in a position to be readable by a person seated at such table or desk. heretofore, such book holders have been secured to the desk top or clamped in place for ease of removal when not needed.

The present invention seeks to overcome the problem of removing and replacing a book holder between uses. It also contemplates the provision of a foldaway unit by which the book holder may be removed from the table or desk top although secured thereto. By such arrangement the book holder need not be stored in a location remote from the desk and will always be available for use should the occasion require. This is most advantageous in classroom type student desks in which the desk top is constructed as one armrest and permanent part of the student's classroom chair. Such desk top allows little extra room on its upper surface for the support of text books and the like while the student is making copies or writing during study. Moreover, when it is considered that a student must sit at one of these desk type chairs from 4 to 6 hours out of the classroom day, the present type book holder will relieve him of the burden and fatigue associated with the juggling of a book while he uses the desk top as a writing surface.

The book holder of the present invention is set at a very limited area of the desk top and is adjustable for supporting a book at a desired angle relative to the student's line of vision. In addition thereto, the adjustable feature is so constituted as to enable the student to fold the holder portion back and out of the way when not needed, as for example, during the writing of an examination paper.

These and other objects and advantages of the present invention will become apparent from a reading of the following detailed description and claims in the light of the accompanying two sheets of drawing in which:

FIG. 1 is a perspective view of the book holder of the present invention as seen attached to the back edge of a student type desk top shown fragmentarily;

FIG. 2 is perspective view of the book holder of FIG. 1 as seen looking toward the back edge of the desk top;

FIG. 3 is a bottom plan of the book holder showing a portion of the desk top fragmentarily;

GENERAL DESCRIPTION

Figure 6:
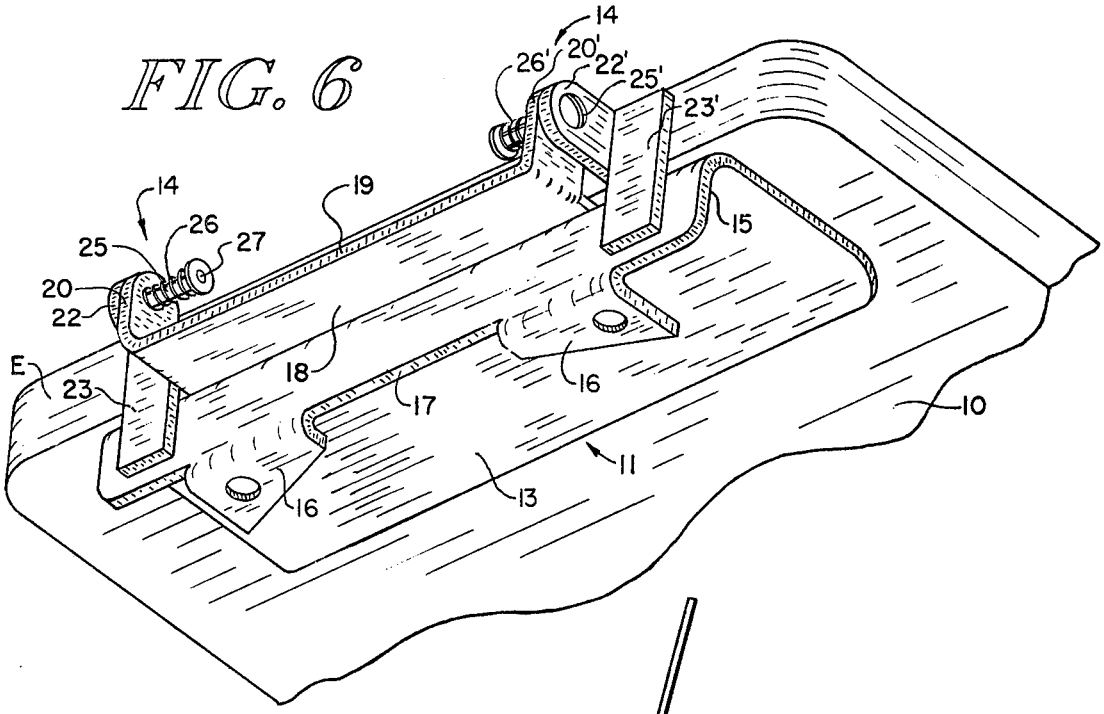
FIG. 6 is a fragmentary perspective view of the back edge of the desk top as seen from below and with the book supporting portion of the holder folded back under the desk top.

Referring to the drawings and in particular to FIG. 1, a desk top 10 is shown to be of a limited size such as is provided in a student type desk which forms one arm of a seat or chair (not shown) below an indented edge I along one side of the desk top 10.

The book holder generally designated 11 comprises a base 12 to which a back support 13 for a book is hingedly mounted as at 14. The back support 13 is provided with a forwardly extending ledge or shelf 15 upon which the lower edge of an open book may be supported. A pair of upturned flanges 16 on the forward edge 17 of the shelf 15 serve to support an open book thereon and to hold the pages of such open book back and in open condition thereon.

DETAILED DESCRIPTION

In accordance with the present invention the book holder 11 therof does not occupy more than a limited space on the desk top. It is constructed to fit adjacent the back edge E of the desk remote from the seat thereof.

The base 12 of the book holder 11 is a flat plate as best shown in FIG. 3. The base 12 is an elongated plate 18 extending more than the span of an open book resting upon the book supporting ledge or shelf 15 of the book holder 11. The back edge 19 of the plate 18 has a pair of upturned ears 20–20' on each of its narrower ends 21 and 21', respectively. These ears 20–20' serve as a trunion for the hinge mount 14 of the holder 11.

The hinge mount 14 further includes a pair of companion ears 22–22' formed as a part of rearwardly extending portions 23 and 23', respectively, of the back support 13. The rearwardly extending portions 23 and 23' of the back support are shown as separate parts welded to the underside of the shelf portion 15 of the holder 11. It should be understood, however, that such rearwardly extending portions may be die punched out the material constituting the back support 13, if desired. The ears 22–22' on the portions 23 and 23' extend downwardly from the plane thereof in spaced relation, preferably, to embrace the ears 20 and 20' at the back edge 19 of the base plate 18. Moreover, as a counterbalance to the weight of the back support 13 and a book thereon, the ears 22–22' on the rearwardly extending portion 23 and 23' are disposed a distance rearwardly of the back support 13 substantially comparable to the forward extention of the shelf 15 therefrom, as best seen in FIG. 3.

Figure 4:
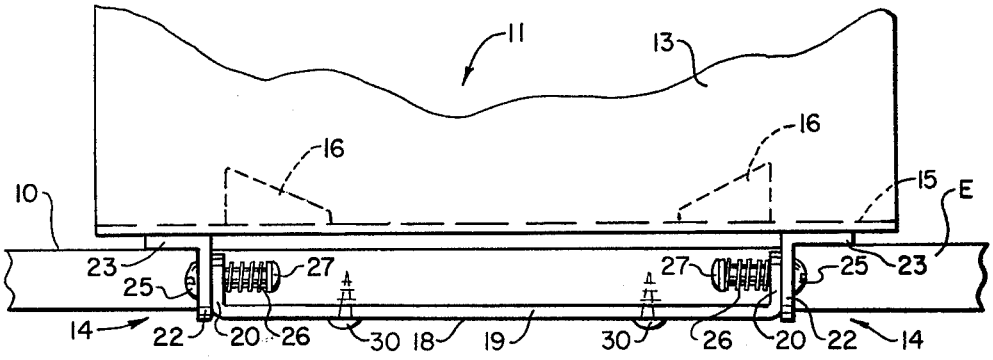
FIG. 4 is a back elevational view of the book holder of FIG. 2 with the upper portion of the book rest broken away.

The hinge mount 14 is completed as shown in FIG. 4 by spring loaded pivot pins 25–25' for pivotally connecting the companion ears 20–22 and 20'–22' together. The pins 25–25' each have a compression spring 26–26', respectively, between a peened end 27 and 27', as the case may be, of the inner end of each pin. This affords a friction bearing between the companion ears 20–22 and 20'–22', respectively, to hold the back support 13 in any desired position of adjustment for supporting a book on the ledge or shelf 15 thereof.

Figure 5:
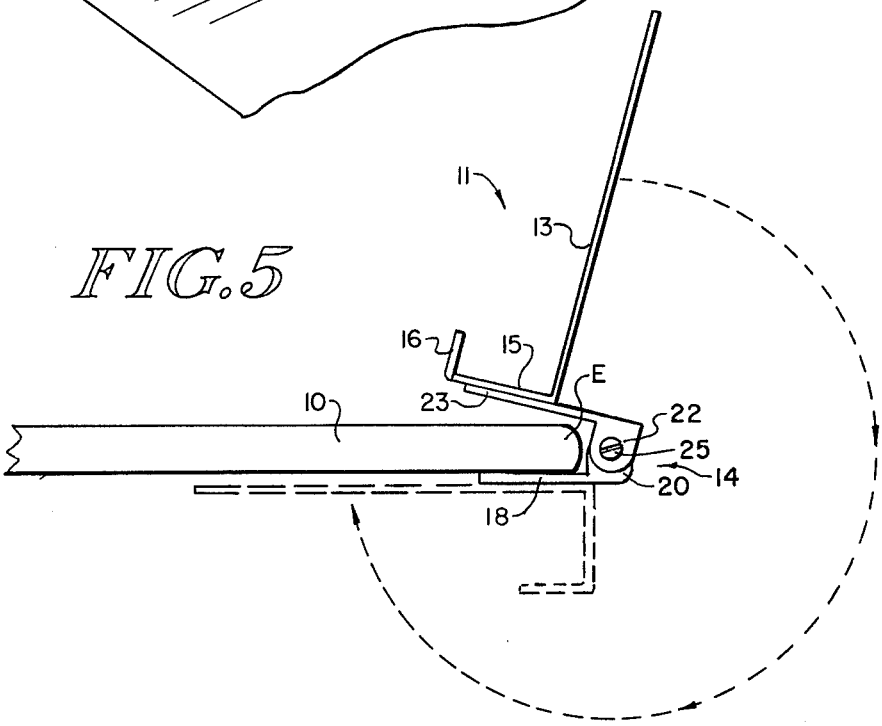
FIG. 5 is a side elevational view of the desk top and book holder as seen lefthand sides thereof in FIG. 2.

By the foregoing arrangement, the entire book holder 11 may be permanently secured to the desk top 10. As best seen in FIGS. 4 and 5, the base plate 18 and shelf 15 are spaced from each other substantially the thickness of a desk top board. This enables the disposition of the base plate 18 beneath such desk top 10 while the shelf portion of the holder 11 is disposed above the desk top. The base plate 18 may then be secured to the underside of the desk top 10 by a pair of screws 30. As shown in FIGS. 4 and 5, the pivotal mount 14 is thus substantially midway the top and bottom surfaces of the desk top 10 adjacent the back edge E of the latter. The book holding ledge or shelf 15 as well as the back support 13 is thereby disposed in a very limited zone of the desk top, adjacent the back edge E thereof and may be completely swung away from such zone and back under the desk top as illustrated in dotted lines in FIG. 5.

Having thus described the book holder of the present invention in specific detail, it will be appreciated by those skilled in the art that the same may be modified, altered, or varied without departing from the spirit or scope of the invention therein as expressed in the appended claims.

What I claim and desire to protect by Letters Patent is:

1. A book holder for a student type desk forming one arm of a classroom chair, the combination therewith of:

(1) a back support for a book and having a forwardly extending ledge at its lower edge for supporting an open book thereon;

(2) a flat plate base disposed beneath said back support and extending laterally the width of an open book on the ledge thereof;

(3) said flat plate base having a back edge;

(4) a pair of upwardly extending ears at each end of said flat plate base adjacent the back edge thereof;

(5) a pair of downwardly extending ears secured to the underside of the ledge on said back support and extending rearwardly therefrom for embracing said pair of ears on said flat plate base; and (6) means for pivotally connecting each of said downwardly extending ears on said ledge of the back support to a respective one of the upstanding ears on said base flat plate base for hingedly mounting said ledge and back support thereto.

2. The book holder in accordance with that of claim 1 in which said means for pivotally connecting said ears together comprises a pair of pivot pins for each of said set of ears.

3. The book holder in accordance with that of claim 2 including spring means on each of said pivot pins for frictionally holding the respective ears of each set thereon in frictional contact with each other to thereby maintain the back support and ledge thereof with a book thereon in adjusted position.

4. The book holder in accordance with claim 3 in which said sets of ears are so formed in respect to said flat plate base and ledge of the back support as to receive the back edge of a desk top between them, and means for securing said flat plate base to the underside of such desk top whereby said back support and ledge thereon are disposed to swing back to a position completely below said desk top for storage thereunder.

* * * * *